US009523184B2

(12) United States Patent
Kim

(10) Patent No.: US 9,523,184 B2
(45) Date of Patent: Dec. 20, 2016

(54) HYBRID EXCAVATOR HAVING A SYSTEM FOR REDUCING ACTUATOR SHOCK

(75) Inventor: Jae-Hong Kim, Gimhae-si (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 319 days.

(21) Appl. No.: 14/353,157

(22) PCT Filed: Oct. 27, 2011

(86) PCT No.: PCT/KR2011/008074

§ 371 (c)(1),
(2), (4) Date: Apr. 21, 2014

(87) PCT Pub. No.: WO2013/062156

PCT Pub. Date: May 2, 2013

(65) Prior Publication Data

US 2014/0245734 A1 Sep. 4, 2014

(51) Int. Cl.
*F15B 7/00* (2006.01)
*E02F 9/22* (2006.01)
(Continued)

(52) U.S. Cl.
CPC ..... *E02F 9/2207* (2013.01); *E02F 3/43* (2013.01); *E02F 3/435* (2013.01); *E02F 9/2095* (2013.01); *E02F 9/2228* (2013.01); *E02F 9/2289* (2013.01); *F15B 7/006* (2013.01); *F15B 11/048* (2013.01); *F15B 2211/20561* (2013.01); *F15B 2211/27* (2013.01); *F15B 2211/3058* (2013.01);
(Continued)

(58) Field of Classification Search
CPC ..... E02F 9/2207; E02F 3/435; F15B 7/10; F15B 2211/611
USPC ..... 137/596.1, 596.14
See application file for complete search history.

(56) References Cited

U.S. PATENT DOCUMENTS 4,227,442 A * 10/1980 Oguni ..... F03C 1/007 91/235
2009/0071145 A1 3/2009 Kim
2011/0030364 A1* 2/2011 Persson ..... E02F 9/2217 60/428

FOREIGN PATENT DOCUMENTS

JP 2002276832 A * 9/2002
JP 2004019437 A 1/2004
(Continued)

OTHER PUBLICATIONS

International Search Report mailed Jul. 19, 2012 for PCT/KR2011/008074.
Written Opinion mailed Jul. 19, 2012 for PCT/KR2011/008074.

*Primary Examiner* — Thomas E Lazo
*Assistant Examiner* — Abiy Teka
(74) *Attorney, Agent, or Firm* — Hauptman Ham, LLP

(57) ABSTRACT

Disclosed is a hybrid excavator which reduces the impact generated at the start of the operation of the boom cylinder, or the like, of a hybrid excavator. The hybrid excavator according to the present invention comprises: a hydraulic pump motor connected to an electric motor and operated in the forward or reverse direction; a hydraulic cylinder connected to the hydraulic pump motor and operated in an expanding manner; a first and second hydraulic valve installed in a first and second passage, respectively, between the hydraulic pump motor and the hydraulic cylinder, for blocking the first and second passages when switched by an external control signal; a third hydraulic valve installed in the connecting path connected to first and second dividing passages.

4 Claims, 11 Drawing Sheets

(51) Int. Cl.

| | |
|---|---|
| ***E02F 3/43*** | (2006.01) |
| ***F15B 11/048*** | (2006.01) |
| ***E02F 9/20*** | (2006.01) |

(52) U.S. Cl.

CPC ..... *F15B 2211/30515* (2013.01); *F15B 2211/50527* (2013.01); *F15B 2211/613* (2013.01); *F15B 2211/7053* (2013.01); *F15B 2211/851* (2013.01); *F15B 2211/8613* (2013.01)

(56) References Cited

FOREIGN PATENT DOCUMENTS

| | | | |
|---|---|---|---|
| JP | 2005016708 | A | 1/2005 |
| KR | 1020090028216 | A | 3/2009 |
| KR | 10-2010-0134827 | A | 12/2010 |

* cited by examiner

HYBRID EXCAVATOR HAVING A SYSTEM FOR REDUCING ACTUATOR SHOCK

CROSS REFERENCE TO RELATED APPLICATION

This application is the National Phase application of International Application No. PCT/KR2011/008074 filed on Oct. 27, 2011, which is incorporated herein by reference in its entirety.

FIELD OF THE INVENTION

The present invention relates to a hybrid excavator provided with an actuator impact reduction system. More particularly, the present invention relates to a hybrid excavator provided with an actuator impact reduction system, in which in the hybrid excavator that controls the expansion and contraction of the hydraulic cylinder as the electric motor is rotated in a forward and reverse rotation direction, a shuttle valve operated by a difference in pressure of flow paths is driven according to a direction of a force exerted to a piston of a hydraulic cylinder, so that an impact generated at the start of the operation of a boom cylinder or the like can be reduced.

BACKGROUND OF THE INVENTION

In general, in a hybrid excavator, a boom cylinder or the like is expanded and contracted by a hydraulic fluid discharged from a hybrid actuator (e.g., hydraulic pump-motor) in response to the drive of an electric motor to cause a work apparatus, i.e., an attachment such as a boom or the like to be manipulated. In other words, as the electric motor is rotated in a forward and reverse direction, the expansion and contraction of the boom cylinder can be controlled. In a work mode in which the boom descends, a high pressure is generated in a large chamber of the boom cylinder by the boom's own weight, and the hydraulic pump-motor is driven by a hydraulic fluid discharged from the large chamber to cause the electric motor to generate electricity.

A general hybrid excavator shown in FIGS. 1 to 5 includes:

an electric motor 11;

a hydraulic pump-motor 12 that is connected to the electric motor 11 and is driven in a forward or reverse direction;

a hydraulic cylinder 15 (e.g., not limited to a boom cylinder) that is expanded and contracted by a hydraulic fluid that is supplied along first and second flow paths 13 and 14 connected to the hydraulic pump-motor 12;

first and second hydraulic valves 16 and 17 that are installed in the first and second flow paths 13 and 14 between the hydraulic pump-motor 12 and the hydraulic cylinder 15, respectively, and are shifted to control the first and second flow paths 13 and 14 in response to a control signal applied thereto from the outside; and a third hydraulic valve 21 (shifted using a pressure of the first and second flow paths 13 and 14 as a pilot signal pressure) that is installed in a connection path 20 connected to first and second branch flow paths 18 and 19 that are branch-connected to the first and second flow paths 13*a* and 14*a* on an upstream side of the first and second hydraulic valves 16 and 17 and the first and second flow paths 13*b* and 14*b* on a downstream side of the first and second hydraulic valves 16 and 17, respectively, and compensates for or bypasses a flow rate of the hydraulic fluid in order to overcome a difference in flow rate of the hydraulic fluid, which occurs due to a difference in cross section between a large chamber 15*b* and a small chamber 15*a* of the hydraulic cylinder 15 when the hydraulic pump-motor 12 is rotated in a forward and reverse direction.

In this case, the configuration of an attachment 6 consisting of a boom 1, an arm 2, and a bucket 3, which are driven by respective hydraulic cylinders 15, 4 and 5, and an operator's cab 7 is the same as that of an excavator in the art to which the present invention pertains, and thus the detailed description of the configuration and operation thereof will be omitted to avoid redundancy.

Hereinafter, an operation example of the hybrid excavator will be described with reference to the accompanying drawings.

As shown in FIG. 1, as the hydraulic pump-motor 12 is rotated in a forward or reverse direction, a hydraulic fluid from the hydraulic pump-motor 12 is supplied to the large chamber 15*b* of the hydraulic cylinder 15 through the second flow path 14:14*a;* 14*b*, or a hydraulic fluid from the hydraulic pump-motor 12 is supplied to the small chamber 15*a* of the hydraulic cylinder 15 through the first flow path 13:13*a;* 13*b* so that the hydraulic cylinder 15 can be expanded or contracted.

As shown in FIG. 2, in a state in which a high pressure is generated in the large chamber 15*b* of the hydraulic cylinder 15 by a direction 1 of a load applied to the 10 hydraulic cylinder 15, the hydraulic fluid from the hydraulic pump-motor 12 is supplied to the large chamber 15*b* of the hydraulic cylinder 15 through the second flow path 14 in response to the drive of the electric motor 11, and the hydraulic fluid from the small chamber 15*a* of the 15 hydraulic cylinder 15 is drained through the first flow path 13 to cause the hydraulic cylinder 15 to be expanded.

A pressure formed in the second flow path 14 is higher than that formed in the first flow path 13, and thus the third hydraulic valve 21 using the hydraulic fluid of the 20 first and second flow paths 13 and 14 as a pilot signal pressure is shifted to the top on the drawing sheet. In this case, since the cross section of the large chamber 15*b* of the hydraulic cylinder 15 is larger than that of the small chamber 15*a* of the hydraulic cylinder 15, the hydraulic fluid compensated through a drain line 22 is supplied to the large chamber 15*b* of the hydraulic cylinder 15.

As shown in FIG. 3, in a state in which a high pressure is generated in the large chamber 15*b* of the hydraulic cylinder 15 by a direction 1 of a load applied to the 5 hydraulic cylinder 15, the hydraulic fluid from the hydraulic pump-motor 12 is supplied to the small chamber 15*a* of the hydraulic cylinder 15 through the first flow path 13 in response to the drive of the electric motor 11, and the hydraulic fluid from the large chamber 15*b* of the 10 hydraulic cylinder 15 is drained through the second flow path 14 to cause the hydraulic cylinder 15 to be contracted.

The high-pressure hydraulic fluid returned from the large chamber 15*b* of the hydraulic cylinder 15 is introduced into the hydraulic pump-motor 12 to cause the hydraulic 15 pump-motor 12 to generate electricity. A pressure formed in the second flow path 14 is higher than that formed in the first flow path 13, and thus the third hydraulic valve 21 is shifted to the top on the drawing sheet. In this case, since the cross section of the large chamber 15*b* of the 20 hydraulic cylinder 15 is larger than that of the small chamber 15*a* of the hydraulic cylinder 15, the hydraulic fluid compensated through a drain line 22 is supplied to the large chamber 15*b* of the hydraulic cylinder 15. At this time, since a flow rate of the hydraulic fluid discharged from the large chamber 15*b* of the hydraulic cylinder 15 is higher than that of the hydraulic fluid introduced into the small chamber 15*a* thereof, the hydraulic fluid flowing in the second flow path 14 is partially moved to the hydraulic tank T while passing through the connection 20 and the drain line 22.

As shown in FIG. 4, in a state in which a high pressure is generated in the small chamber 15*a* of the hydraulic cylinder 15 by a direction 2 of a load applied to the hydraulic cylinder 15, the hydraulic fluid from the hydraulic pump-motor 12 is supplied to the large chamber 15*b* of the hydraulic cylinder 15 through the second flow path 14 in response to the drive of the electric motor 11, and the hydraulic fluid from the small chamber 15*a* of the hydraulic cylinder 15 is drained through the first flow path 13 to cause the hydraulic cylinder 15 to be expanded. At this time, the high-pressure hydraulic fluid returned from the small chamber 15*a* of the hydraulic cylinder 15 is introduced into the hydraulic pump-motor 12 to cause the hydraulic pump-motor 12 to be driven to generate electricity.

A pressure formed in the first flow path 13 is higher than that formed in the second flow path 14, and thus the third hydraulic valve 21 is shifted to the bottom on the drawing sheet. Since a flow rate of the hydraulic fluid needed by the large chamber 15*b* of the hydraulic cylinder 15 is higher than that of the hydraulic fluid discharged from the small chamber 15*a* thereof. In this case, the hydraulic fluid from the hydraulic tank T is sucked in by the third hydraulic valve 21 through the drain line 22, and then joins the hydraulic fluid on the second flow path 14 through the first branch flow path 18.

As shown in FIG. 5, in a state in which a high pressure is generated in the small chamber 15*a* of the hydraulic cylinder 15 by a direction 2 of a load applied to the hydraulic cylinder 15, the hydraulic fluid from the hydraulic pump-motor 12 is supplied to the small chamber 15*a* of the hydraulic cylinder 15 through the first flow path 13 in response to the drive of the electric motor 11, and the hydraulic fluid from the large chamber 15*b* of the hydraulic cylinder 15 is drained through the second flow path 14 to cause the hydraulic cylinder 15 to be contracted.

A pressure formed in the first flow path 13 is higher than that formed in the second flow path 14, and thus the third hydraulic valve 21 is shifted to the bottom on the drawing sheet. Since a flow rate of the hydraulic fluid discharged from the large chamber 15*b* of the hydraulic cylinder 15 is higher than that of the hydraulic fluid introduced into the hydraulic pump-motor 12. In this case, the hydraulic fluid flowing in the second flow path 14 is partially moved to the hydraulic tank T through the first branch flow path 18, the third hydraulic valve 21, and the drain line 22.

As shown in FIG. 6, in the case where the operation of the machine is stopped in a position of an attachment 6 consisting of the boom 1 and the like, a low load occurs in the above-mentioned load direction 1 (e.g., the case where the hydraulic cylinder is contracted) in the respective hydraulic cylinders 15, 4 and 5. In this case, the first and second hydraulic valves 16 and 17 are shifted to a position in which the first and second flow paths 13 and 14 are closed in order to prevent the hydraulic fluid from leaking to the outside when the hydraulic cylinders are not driven, and thus the internal pressure of the hydraulic cylinders is not dropped.

In the meantime, since the hydraulic fluid has somewhat compressibility, vibration may occur due to the abrupt stop of the attachment 6 or the operation (e.g., the case where the drive of the boom cylinder 15 is stopped while the arm cylinder 4 is driven) of another hydraulic cylinder.

As shown in FIG. 7, even in the case where the first and second hydraulic valves 16 and 17 are closed, the hydraulic fluid of the hydraulic cylinder 15 is compensated so that a constant pressure is generated even after occurrence of the vibration. The cross section of the large chamber 15*b* of the hydraulic cylinder 15 is larger than that of the small chamber 15*a* thereof (e.g., twice larger than that of the small chamber 15*a* in a general excavator). Thus, even in the case where the same pressure is generated in the large and small chambers, a force allowing the piston to be moved in the large chamber 15*b* is larger than in the small chamber 15*a*. When a pressure of the large chamber 15*b* is a half that of the small chamber 15*a*, the forces of the large chamber 15*b* and the small chamber 15*a*, which push each other, become the same. In the case where the boom cylinder 15 is contracted by the load direction 1, a pressure (a) of the small chamber 15*a* is higher than a pressure (b) of the large chamber 15*b* (see FIGS. 7 and 8).

As shown FIGS. 8 and 9, the first and second hydraulic valves 16 and 17 are shifted to an opened position through 15 the application of a control signal thereto to perform a work under the conditions where an external force is applied to the hydraulic cylinder 15 by the load direction 1, so that a high pressure is formed in the first flow path 13 and a low pressure is formed in the second flow path 14 to 20 cause the third hydraulic valve 21 to be shifted to the bottom on the drawing sheet.

As shown in FIGS. 9 and 10, when the pressure formed in the large chamber 15*b* is released while the piston of the hydraulic cylinder 15 is moved by several millimeters (mm), the third hydraulic valve 21 is shifted to the top on the drawing sheet to cause the hydraulic cylinder 15 to be operated normally.

As shown in FIGS. 8 and 9, in the process in which the first and second hydraulic valves 16 and 17 are shifted to an opened position from a closed position, and the third hydraulic valve 21 in a neutral position is shifted to the bottom on the drawing sheet by the pressure of the first flow path 13, the piston of the hydraulic cylinder 15 is moved by several millimeters (mm). In this case, although the movement distance of the piston of the hydraulic cylinder 15 is not long, a distal end of the attachment 6 is moved by several meters (m), thereby causing a problem in that manipulability and workability are deteriorated.

DETAILED DESCRIPTION OF THE INVENTION

Technical Problems

Accordingly, the present invention has been made to solve the aforementioned problem occurring in the prior art, and it is an object of the present invention to provide a hybrid excavator provided with an actuator impact reduction system, in which a shuttle valve that controls a difference in flow rate of the hydraulic fluid, which occurs due to a difference in cross section between a large chamber and a small chamber of the hydraulic cylinder is driven according to a direction of a force exerted to a piston of a hydraulic cylinder, so that an impact generated at the start of the operation of the boom cylinder or the like can be reduced, thereby improving manipulability and workability.

Technical Solution

To accomplish the above object, in accordance with an embodiment of the present invention, there is provided a hybrid excavator provided with an actuator impact reduction system, wherein the actuator impact reduction system includes:

an electric motor;

a hydraulic pump-motor connected to the electric motor and configured to be driven in a forward or reverse direction;

a hydraulic cylinder configured to be expanded and contracted by a hydraulic fluid that is supplied along first and second flow paths connected to the hydraulic pump-motor;

first and second hydraulic valves installed in the first and second flow paths between the hydraulic pump-motor and the hydraulic cylinder, respectively, and configured to be shifted to control the first and second flow paths in response to a control signal applied thereto from the outside;

a third hydraulic valve installed in a connection path connected to first and second branch flow paths that are branch-connected to the first and second flow paths on an upstream side of the first and second hydraulic valves and the first and second flow paths on a downstream side of the first and second hydraulic valves, respectively, and configured to be shifted to compensate for or bypass a flow rate of the hydraulic fluid in order to overcome a difference in flow rate of the hydraulic fluid, which occurs due to a difference in cross section between a large chamber and a small chamber of the hydraulic cylinder; and first and second pilot chambers configured to supply a pressure of the first and second flow paths to the third hydraulic valve as a pilot signal pressure so as to shift the third hydraulic valve, the first and second pilot chambers being formed to have different cross sections.

In accordance with a preferred embodiment of the present invention, the ratio of the cross section between the first and second pilot chambers of the third hydraulic valve may be made equal to the ratio of the cross section between the small chamber and the large chamber of the hydraulic cylinder.

The ratio of the cross section between the first and second pilot chambers of the third hydraulic valve may be 1:2.

The hydraulic cylinder may be anyone of a boom cylinder, an arm cylinder, and a bucket cylinder.

Advantageous Effect

The hybrid excavator provided with an actuator impact reduction system in accordance with an embodiment of the present invention as constructed above has the following advantages.

The shuttle valve operated by a difference in pressure of flow paths between the hydraulic pump and the hydraulic cylinder is configured such that the ratio of the cross section between the first and second pilot chambers of the shuttle valve is made equal to the ratio of the cross section between the small chamber and the large chamber of the hydraulic cylinder 15, so that the shuttle valve is driven according to a direction of a force exerted to the piston of the hydraulic cylinder. Thus, an impact generated at the start of the operation of the boom cylinder or the like can be reduced, thereby improving manipulability.

BRIEF DESCRIPTION OF THE DRAWINGS

The above objects, other features and advantages of the present invention will become more apparent by describing the preferred embodiments thereof with reference to the accompanying drawings, in which.

EXPLANATION ON REFERENCE NUMERALS OF MAIN ELEMENTS IN THE DRAWINGS

Figure 1:
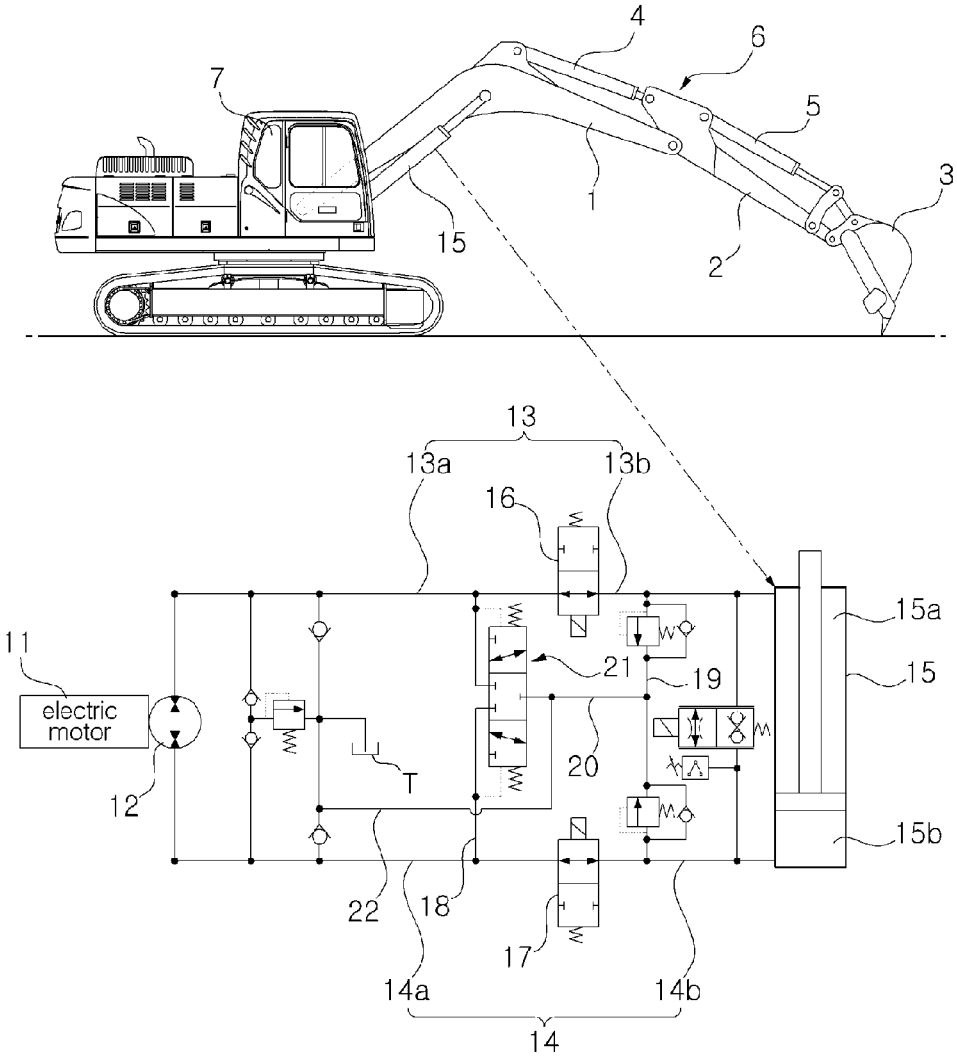
FIG. 1 is a schematic view showing a hybrid excavator to which an actuator impact reduction system in accordance with an embodiment of the present invention is applied.
Figure 2:
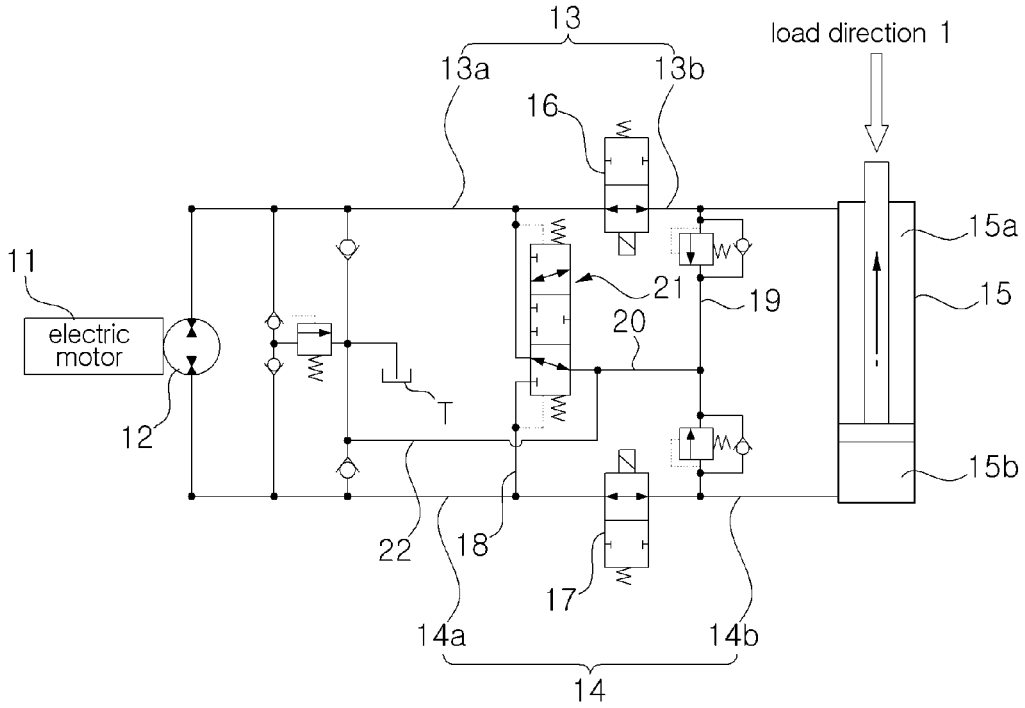
FIGS. 2 to 5 are hydraulic circuit diagrams showing the operation of the hybrid excavator shown in FIG. 1.
Figure 3:
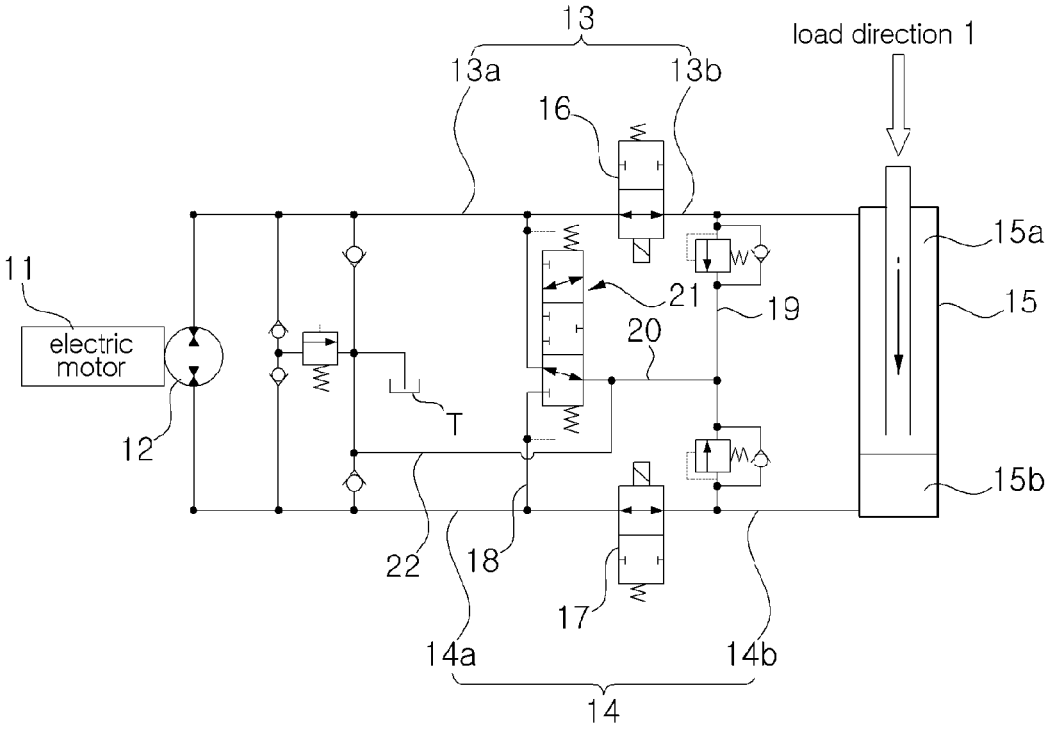
Figure 4:
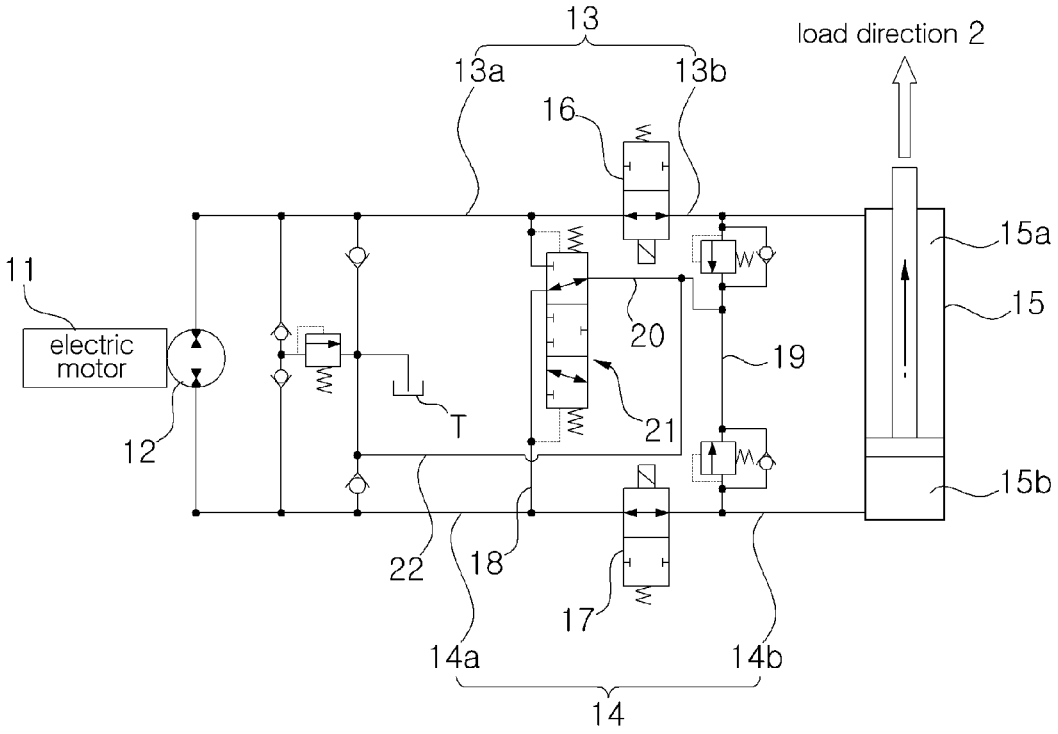
Figure 5:
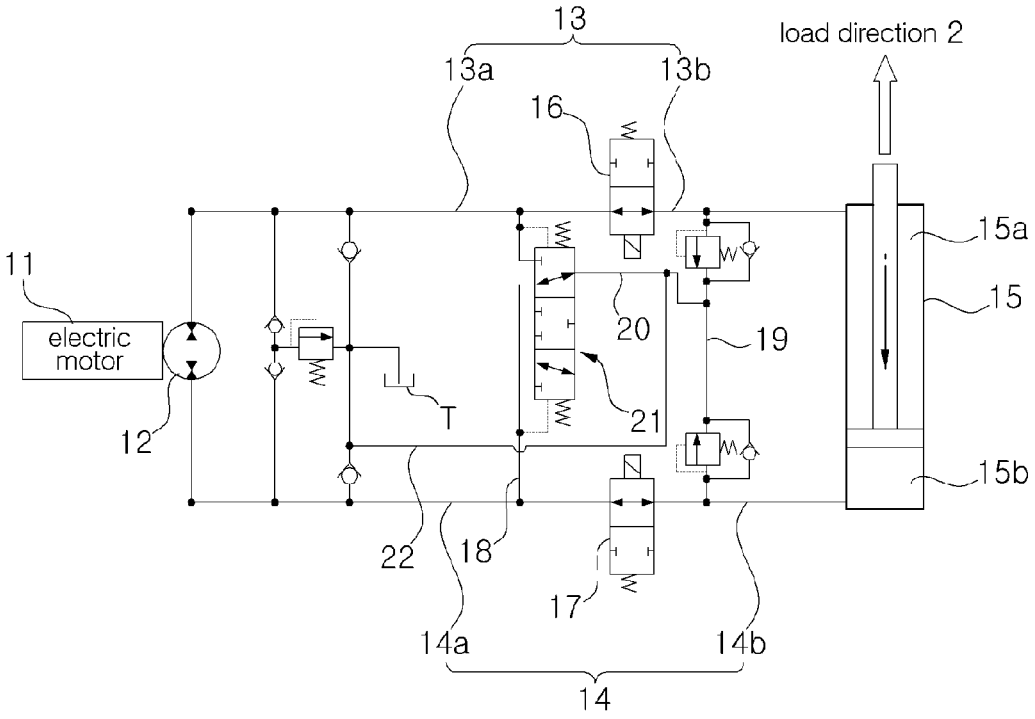
Figure 6:
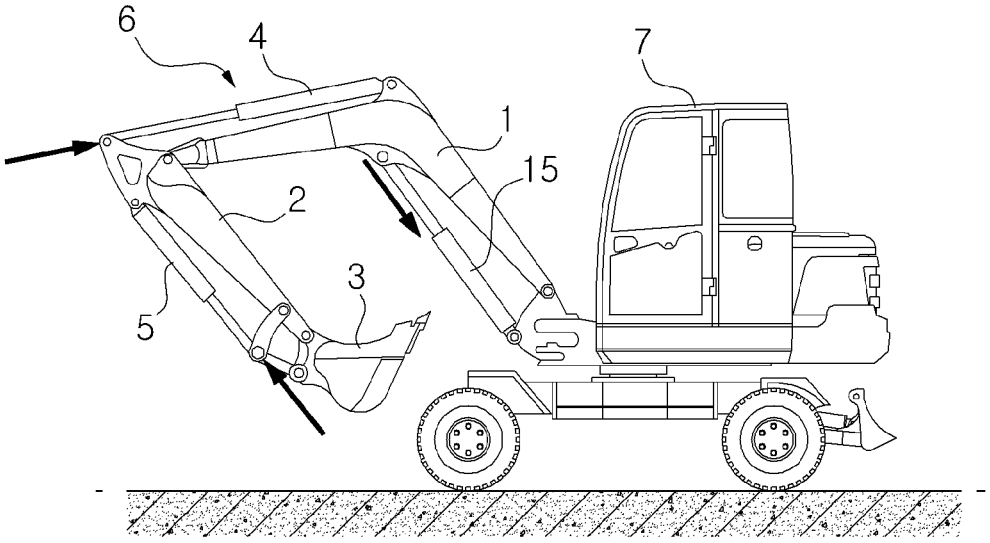
FIG. 6 is a view showing a state in which a low load occurs in a direction in which an actuator is contracted in a hybrid excavator to which an actuator impact reduction system in accordance with an embodiment of the present invention is applied.
Figure 7:
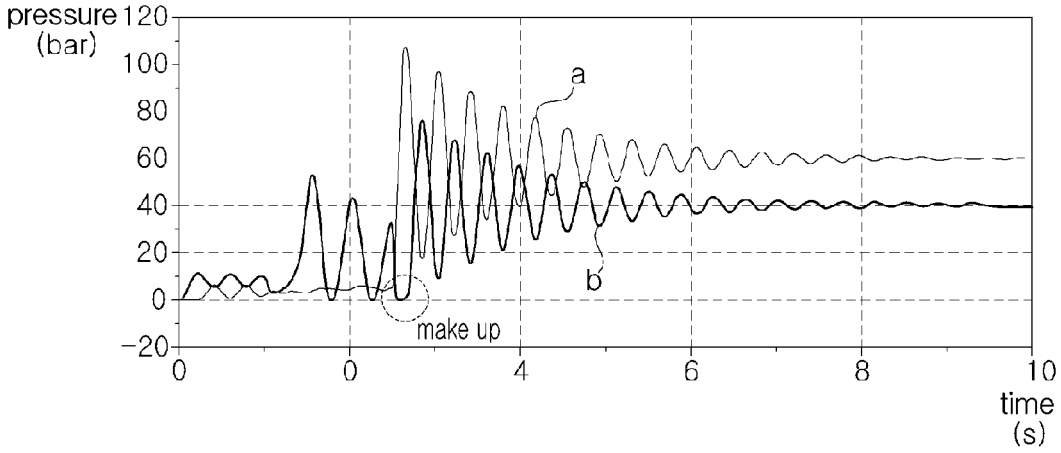
FIG. 7 is a graph showing a state in which a pressure of a small chamber of an actuator is higher than that of a large chamber of the actuator when a load occurs in a direction in which the actuator is contracted in a hybrid excavator to which an actuator impact reduction system in accordance with an embodiment of the present invention is applied.
Figure 8:
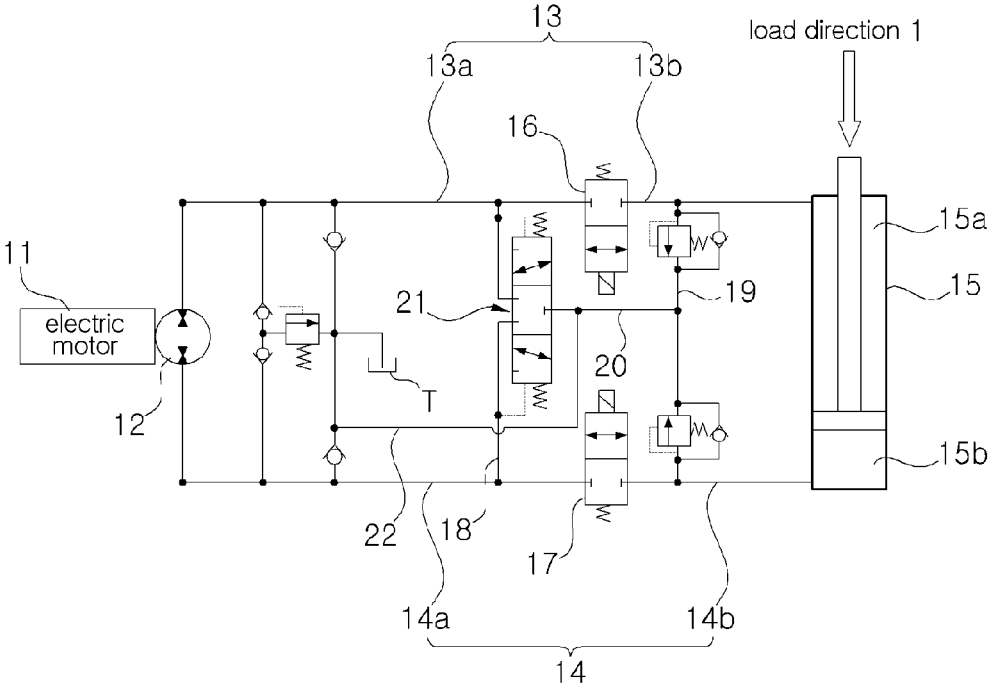
FIG. 8 is a hydraulic circuit diagram showing a state in which a pressure of a small chamber of an actuator is higher than that of a large chamber of the actuator when a load occurs in a direction in which the actuator is contracted in a hybrid excavator to which an actuator impact reduction system in accordance with an embodiment of the present invention is applied.
Figure 9:
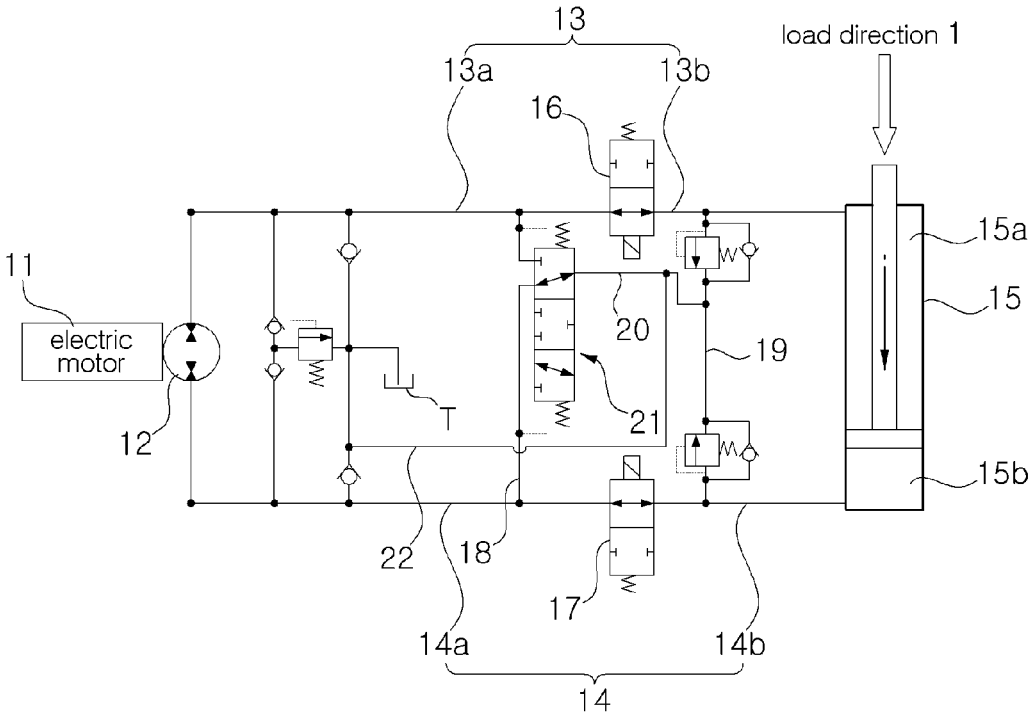
FIG. 9 is a hydraulic circuit diagram showing an erroneous operation of a shuttle valve during the drive of an actuator piston in a neutral position of the shuttle valve shown in FIG. 8 in a hybrid excavator to which an actuator impact reduction system in accordance with an embodiment of the present invention is applied.
Figure 10:
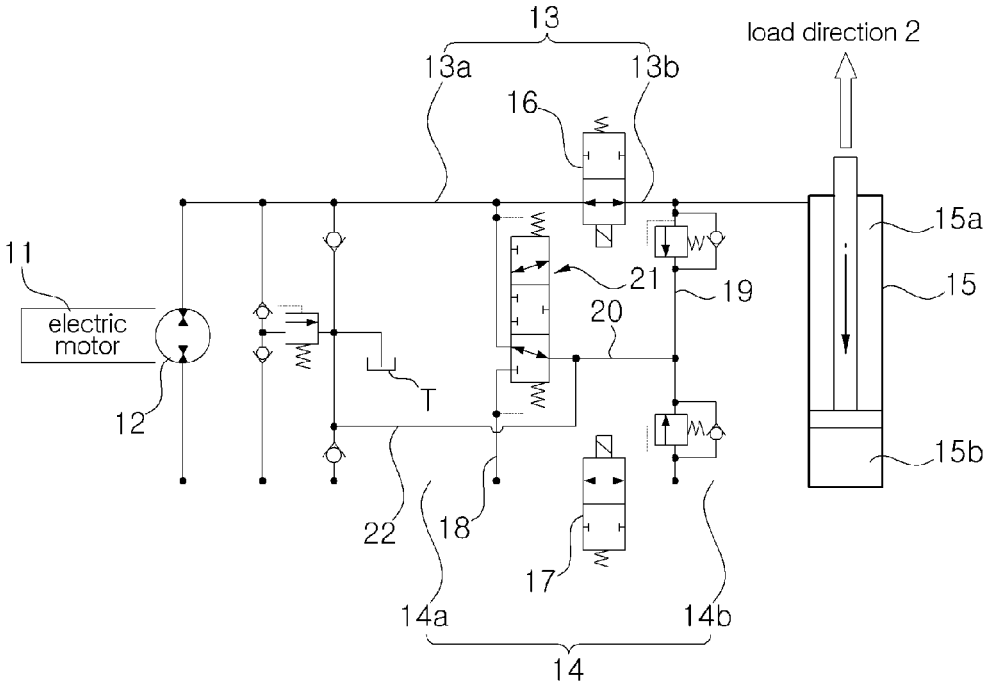
FIG. 10 is a hydraulic circuit diagram showing a state in which an actuator piston is driven by a predetermined amount and a shuttle valve returns to a normal position in a hybrid excavator to which an actuator impact reduction system in accordance with an embodiment of the present invention is applied.
Figure 11:
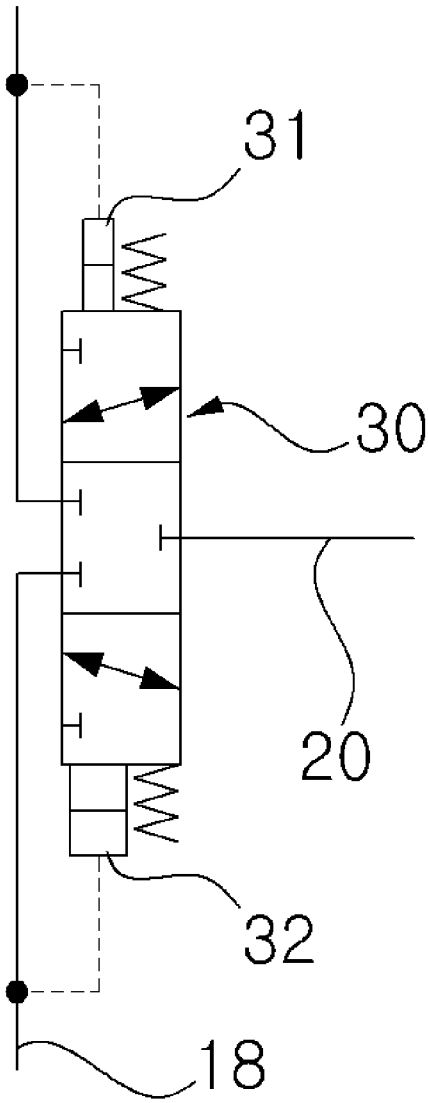
FIG. 11 is a schematic view showing main elements of a shuttle valve in a hybrid excavator to which an actuator impact reduction system in accordance with an embodiment of the present invention is applied.

11: electric motor
12: hydraulic pump-motor
13: first flow path
14: second flow path
15: hydraulic cylinder
16: first hydraulic valve
17: second hydraulic valve
18: first branch flow path
19: second branch flow path
20: connection path
30: third hydraulic valve
31: first pilot chamber
32: second pilot chamber Preferred Embodiments of the Invention Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

In a hybrid excavator provided with an actuator impact reduction system in accordance with an embodiment of the present invention as shown in FIGS. 1 to 11, the actuator impact reduction system includes:

an electric motor 11;

a hydraulic pump-motor 12 that is connected to the electric motor 11 and is driven in a forward or reverse direction;

a hydraulic cylinder 15 that is expanded and contracted by a hydraulic fluid that is supplied along first and second flow paths 13 and 14 connected to the hydraulic pump-motor 12;

first and second hydraulic valves 16 and 17 that are installed in the first and second flow paths 13 and 14 between the hydraulic pump-motor 12 and the hydraulic cylinder 15, respectively, and are shifted to control the first and second flow paths 13 and 14 in response to a control signal applied thereto from the outside;

a third hydraulic valve 30 that is installed in a connection path 20 connected to first and second branch flow paths 18 and 19 that are branch-connected to the first and second flow paths 13*a* and 14*a* on an upstream side of the first and second hydraulic valves 16 and 17 and the first and second flow paths 13*b* and 14*b* on a downstream side of the first and second hydraulic valves 16 and 17, respectively, and is shifted to compensate for or bypass a flow rate of the hydraulic fluid in order to overcome a difference in flow rate of the hydraulic fluid, which occurs due to a difference in cross section between a large chamber 15*b* and a small chamber 15*a* of the hydraulic cylinder 15; and first and second pilot chambers 31 and 32 that supplies a pressure of the first and second flow paths 13 and 14 to the third hydraulic valve 30 as a pilot signal pressure so as to shift the third hydraulic valve 30 (i.e., the third hydraulic valve is driven according to a direction of a force exerted to a piston of the third hydraulic valve 30 so that an impact occurring at the start of the operation of the hydraulic cylinder 15 can be reduced), the first and second pilot chambers being formed to have different cross sections.

In this case, the ratio of the cross section between the first and second pilot chambers 31 and 32 of the third hydraulic valve 30 is made equal to the ratio of the cross section between the small chamber 15*a* and the large chamber 15*b* of the hydraulic cylinder 15.

The ratio of the cross section between the first and second pilot chambers 31 and 32 of the third hydraulic valve 30 is 1:2.

The hydraulic cylinder 15 is any one of a boom cylinder, an arm cylinder, and a bucket cylinder.

In the case, the configuration of the hybrid excavator provided with an actuator impact reduction system in accordance with an embodiment of the present invention is the same as that of the conventional hybrid excavator shown in FIG. 1, except the third hydraulic valve 30 including the first and second pilot chambers 31 and 32 of the third hydraulic valve 30, between which the ratio of the cross section is made equal to the ratio of the cross section between the small chamber 15*a* and the large chamber 15*b* of the hydraulic cylinder 15 and which are formed to have different cross sections. Thus, the detailed description of the same configuration and cooperation thereof will be omitted to avoid redundancy, and the same elements are denoted by the same reference numerals.

Hereinafter, a use example of the hybrid excavator provided with an actuator impact reduction system in accordance with an embodiment of the present invention will be described in detail with reference to the accompanying drawings.

As shown in FIGS. 1 to 11, when a hydraulic fluid from the hydraulic pump-motor 12 is supplied to the hydraulic cylinder 15 by the drive of the electric motor 12 as the electric motor 12 is rotated in a forward and reverse direction, a difference in flow rate of the hydraulic fluid, which occurs due to a difference in cross section between the large chamber 15*b* and the small chamber 15*a* of the hydraulic cylinder 15, can be overcome. In other words, the ratio of the cross section between the first and second pilot chambers 31 and 32 of the third hydraulic valve 30 is made equal to the ratio of the cross section between the small chamber 15*a* and the large chamber 15*b* of the hydraulic cylinder 15.

For this reason, when the hydraulic fluid discharged from the hydraulic pump-motor 12 is supplied to the hydraulic cylinder 15 by the drive of the electric motor 12, the third hydraulic valve 30 compensates for a flow rate of the hydraulic fluid by a difference in flow rate of the hydraulic fluid, which occurs due to a difference in cross section between the large chamber 15*b* and the small chamber 15*a* of the hydraulic cylinder 15 or drains a surplus hydraulic fluid to a hydraulic tank T. Thus, the hydraulic fluid discharged from the hydraulic pump-motor 12 can be supplied to the hydraulic cylinder 15 including the large chamber 15*b* and the small chamber 15*a* whose cross sections are different from each other under the optimal conditions.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

INDUSTRIAL APPLICABILITY

As described above, according to the hybrid excavator provided with an actuator impact reduction system in accordance with an embodiment of the present invention, in the hybrid excavator that controls the expansion and contraction of the hydraulic cylinder as the electric motor is rotated in a forward and reverse rotation direction, the shuttle valve is configured such that the ratio of the cross section between the first and second pilot chambers of the shuttle valve is made equal to the ratio of the cross section between the small chamber and the large chamber of the hydraulic cylinder 15, so that the shuttle valve is driven according to a direction of a force exerted to the piston of the hydraulic cylinder. As a result, an impact generated at the start of the operation of the boom cylinder or the like can be reduced.

The invention claimed is:

1. A hybrid excavator provided with an actuator impact reduction system, wherein the actuator impact reduction system comprises:

an electric motor;

a hydraulic pump-motor connected to the electric motor and configured to be driven in a forward or reverse direction;

a hydraulic cylinder configured to be expanded and contracted by a hydraulic fluid that is supplied along first and second flow paths connected to the hydraulic pump-motor;

first and second hydraulic valves installed in the first and second flow paths between the hydraulic pump-motor and the hydraulic cylinder, respectively, and configured to be shifted to control the first and second flow paths in response to a control signal applied thereto from outside;

a third hydraulic valve installed in a connection path connected to first and second branch flow paths that are branch-connected to the first and second flow paths on an upstream side of the first and second hydraulic valves and the first and second flow paths on a downstream side of the first and second hydraulic valves, respectively, and configured to be shifted to compensate for or bypass a flow rate of the hydraulic fluid in order to overcome a difference in flow rate of the hydraulic fluid, which occurs due to a difference in cross section between a large chamber and a small chamber of the hydraulic cylinder; and first and second pilot chambers configured to supply a pressure of the first and second flow paths to the third hydraulic valve as a pilot signal pressure so as to shift the third hydraulic valve, the first and second pilot chambers being formed to have different cross sections, wherein a ratio of the cross section between the first and second pilot chambers of the third hydraulic valve is made equal to a ratio of the cross section between the small chamber and the large chamber of the hydraulic cylinder.

2. The hybrid excavator provided with an actuator impact reduction system according to claim 1, wherein the hydraulic cylinder is any one of a boom cylinder, an arm cylinder, and a bucket cylinder.

3. The hybrid excavator provided with an actuator impact reduction system according to claim 1, wherein the ratio of the cross section between the first and second pilot chambers of the third hydraulic valve is 1:2.

4. A hybrid excavator provided with an actuator impact reduction system, wherein the actuator impact reduction system comprises:

an electric motor; a hydraulic pump-motor connected to the electric motor and configured to be driven in a forward or reverse direction;

a hydraulic cylinder configured to be expanded and contacted by a hydraulic fluid that is supplied along first and second flow paths connected to the hydraulic pump-motor;

first and second hydraulic valves installed in the first and second flow paths between the hydraulic pump-motor and the cylinder, respectively, and configured to be shifted to control the first and second flow paths in response to a control signal applied thereto from outside;

a third hydraulic valve installed in a connection path connected to first and second branch flow paths that are branch-connected to the first and second flow paths on an upstream side of the first and second hydraulic valves and the first and second flow on a downstream side of the first and second hydraulic valves, respectively, and configured to be shifted to compensate for or bypass a flow rate of the hydraulic fluid in order to overcome a difference in flow rate of the hydraulic fluid, which occurs due to a difference in cross section between a large chamber and a small chamber of the hydraulic cylinder; and first and second pilot chambers configured to supply a pressure of the first and second flow paths to the third hydraulic valve as a pilot signal pressure so as to shift the third hydraulic valve, the first and second pilot chambers being formed to have different cross sections, wherein a ratio of the cross section between the first and second pilot chambers of the third hydraulic valve is 1:2.

* * * * *